US005167336A

United States Patent [19]

Lajovic

[11] Patent Number: 5,167,336

[45] Date of Patent: Dec. 1, 1992

[54] STACKABLE CONTAINER

[75] Inventor: Dusan S. Lajovic, Smithfield, Australia

[73] Assignee: Impact International Pty. Ltd., Smithfield, Australia

[21] Appl. No.: 808,519

[22] Filed: Dec. 16, 1991

[30] Foreign Application Priority Data

Dec. 18, 1990 [AU] Australia ..... PK3950

[51] Int. Cl.[5] ..... B65D 1/24

[52] U.S. Cl. ..... 220/23.6; 206/504; 206/511; 206/512

[58] Field of Search ..... 206/503, 504, 509, 597, 206/511, 512; 220/23.6

[56] References Cited

U.S. PATENT DOCUMENTS

| | | | |
|---|---|---|---|
| 3,385,678 | 5/1968 | Sorenson | 206/597 |
| 3,489,314 | 1/1970 | Slapnik | 206/504 |
| 3,756,396 | 9/1973 | Kilroy | 206/509 |
| 3,999,327 | 12/1976 | Immordino | 206/509 |
| 4,258,847 | 3/1981 | Nierman | 206/504 |

FOREIGN PATENT DOCUMENTS 2564432 5/1984 France .

*Primary Examiner*—Joseph Man-Fu Moy
*Attorney, Agent, or Firm*—Albert C. Smith

[57] ABSTRACT

A stackable container (1) partially defined by two spaced apart side walls (3), a portion (5) of each said side wall converging inwardly toward the other side wall to define a surface profile on each side wall which is a mirror image of a corresponding part of the other side wall whereby like containers (1) can be stacked in an overlapping manner to form a closed packed array.

4 Claims, 4 Drawing Sheets

STACKABLE CONTAINER

The present invention relates to a stackable container and to a method of making such a container.

It is known to store drinks, foodstuffs and other products in containers having a variety of shapes and configurations. However, many such containers are not readily stackable in a stable manner in large numbers, and when packed together for storage or transportation, create intersticial voids, and so do not make optimum use of available space.

It is therefore desirable to provide a stackable container which ameliorates these deficiencies of the prior art in this respect, or at least provides a commercially viable alternative.

Accordingly, in a first aspect, the invention provides a stackable container partly defined by two spaced apart side walls, a portion of each said side wall converging inwardly toward the other side wall to define a surface profile on each side wall that is a mirror image of a corresponding part of the other side wall whereby like containers can be stacked in an overlapping manner to form a close packed array.

Preferably, the Side walls converge inwardly from two spaced apart extremities of the container. Preferably also, the side walls converge uniformly toward a midpoint of the container.

In the preferred embodiment, the stackable container is partly defined by two spaced apart ends, which are substantially shorter than the side walls. In one embodiment, the ends of the container are substantially parallel.

The side walls preferably converge inwardly from the parallel ends of the container to form a central region of reduced width with respect to the ends.

It is also preferred that one surface of the container includes outwardly protruding projections adapted for interengagement with corresponding locating formations on a complementary surface of an abutting like container to prevent relative movement of adjacent containers stacked in a particular mating configuration.

In the preferred embodiment, four such projections protrude upwardly from the top of the container adjacent the respective corners, for releaseable locating interengagement with a peripheral edge flange extending downwardly from the bottom of a like container.

In a third aspect, the invention consists in a method of manufacturing a stackable container substantially as described, said method comprising the steps of drawing opposite longitudinal edges of a strip of sheet material into close proximity; joining said longitudinal edges to form a tubular body partly defined by two spaced apart side walls such that a portion of each said side wall converges inwardly to the other side wall to define a surface profile on each side wall that is a mirror image of a corresponding part of the other side wall; extruding a hollow lining member from a die; and expanding the hollow lining member within the tubular body to form a substantially continuous lining in intimate contact with an inner surface of the tubular body.

The invention also includes within its scope a method for manufacturing a stackable container substantially as described above wherein the hollow lining member is extruded continuously from the die, the respective opposite longitudinal edges of a plurality of said strips are drawn into close proximity, the respective opposite longitudinal edges are joined to form a plurality of tubular bodies each being partly defined by two spaced apart side walls such that a portion of each said side wall converges inwardly toward the other side wall to define a surface profile on each side wall that is a mirror image of a corresponding part of the other side wall; the tubular bodies are arranged in spaced apart relationship around the hollow lining member, and wherein said lining member is expanded to form a substantially continuous lining in intimate contact with the inner surface of each said tubular body to form a series of spaced apart laminated tubular bodies joined by intermediate sections of said hollow lining member.

Preferably the strips of material originate from a continuous supply from which they are cut immediately prior to the formation of the tubular bodies. In another embodiment they are formed into tubular bodies prior to being cut and then subsequently moved into engagement with the hollow lining member.

Preferably also, the intermediate sections of the hollow lining member are gathered and sealed to form a series of interconnected individually sealed laminated tubular bodies. The individual sealed bodies may then be separated to form bodies sealed at neither, one, or both ends.

Preferably the hollow member is extruded at a speed slower than that which the strips of material are moved so that a longitudinal stretch is introduced into the extruded lining member as it is inflated and applied to each body.

The laminated bodies produced by this process may be filled at the same time, or very shortly after the hollow lining member is expanded, by means of a filling nozzle positioned within the extrusion die. In this way individually sealed and filled stackable containers may be produced in one process. Such containers are tamper-evident insofar as any attempt to access the contents is immediately apparent as a result of damage to the integrity of the continuously extruded lining member.

A preferred embodiment of the invention will now be described, by way of example only, with reference to the accompanying drawings in which.

Figure 1:
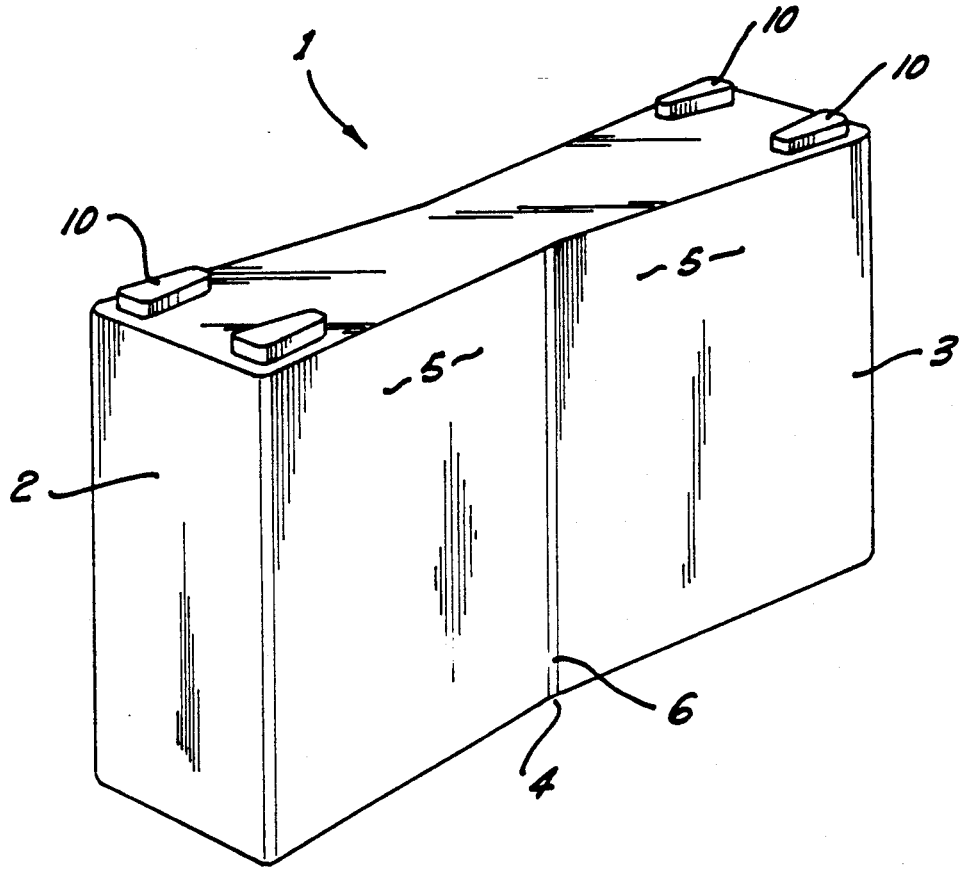
FIG. 1 is a perspective view of a stackable container according to the invention.
Figure 2:
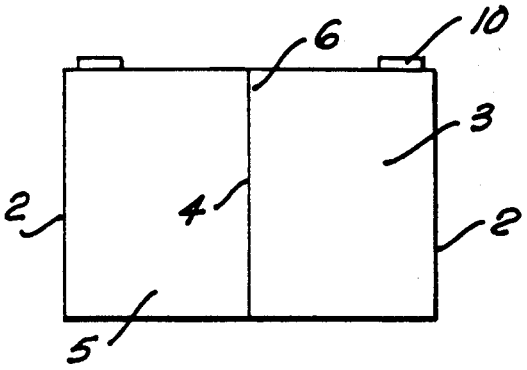
FIG. 2 is a side elevation of the container shown in FIG. 1.
Figure 3:
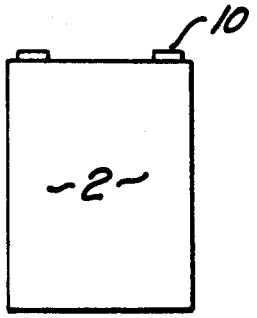
FIG. 3 is an end view of the container of FIG. 1.
Figure 4:
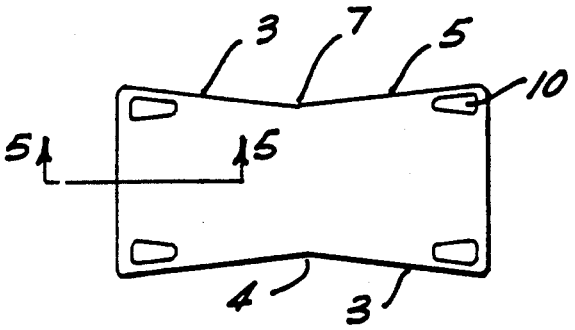
FIG. 4 is a plan view of the container.
Figure 5:
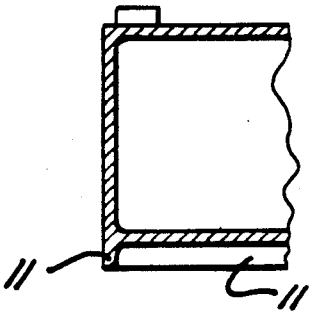
FIG. 5 is a cut away, partly sectioned view taken along line 5—5 of FIG. 4.
Figure 6:
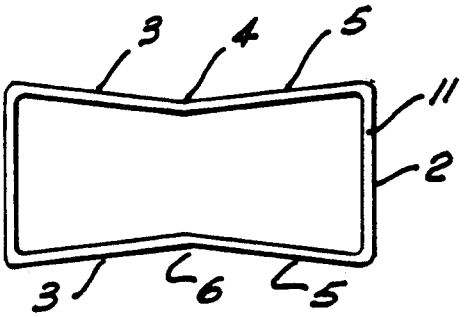
FIG. 6 is an underside view of the container.

Referring to the drawings, wherein corresponding features are denoted by corresponding reference numerals, the invention provides a stackable container 1 defined partly by spaced apart parallel ends 2, and partly by two spaced apart side walls 3. A portion of each side wall converges inwardly toward the opposing side wall to define a surface profile on each side wall that is a mirror image of a corresponding part of the other side wall. More particularly, the side walls converge uniformly inwardly from the ends 2 defining the extremities of the container, toward a mid point 4, of reduced width with respect to the ends. In this way, it will be apparent that a plurality of like containers can be stacked in an overlapping manner in various configuration to form a stable, close packed array.

Figure 8:
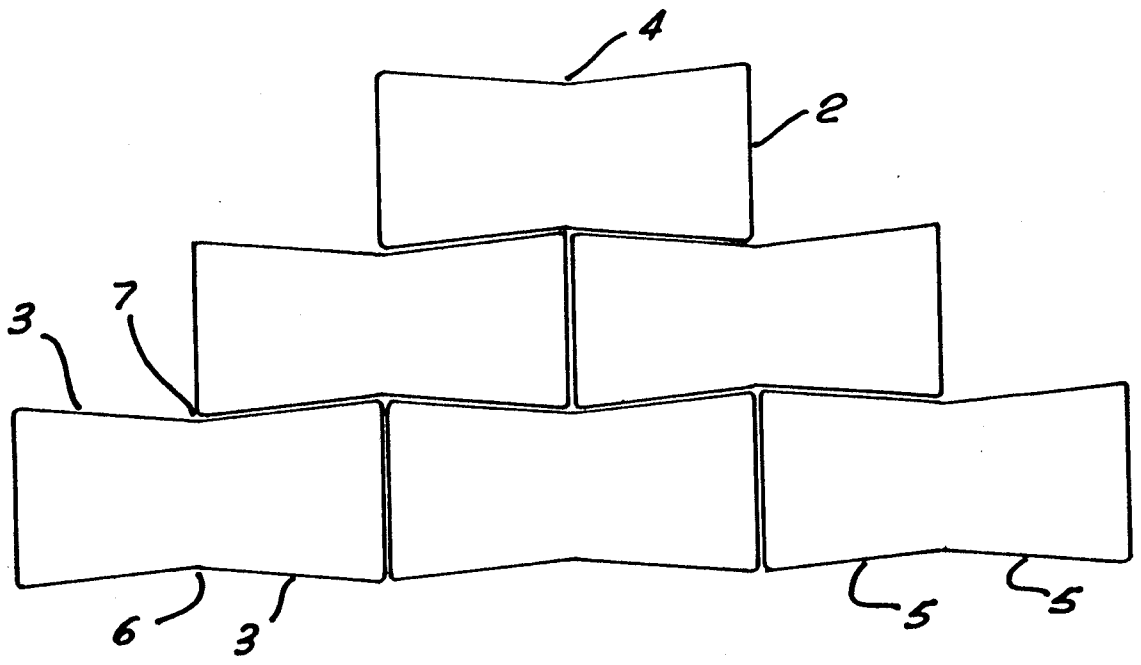
FIG. 8 is a diagrammatic view showing another stacking configuration.

In the preferred embodiment, the ends 2 of the container, and respective diagonally opposed pairs of side wall portions 5 are mutually parallel. The inwardly converging side wall portions 5 intersect to define respective parallel spaced apart edges 6 and 7 at the mid point of the container. In this configuration, as best seen in FIG. 8, the containers are stackable in overlapping staggered relationship such that the end of one container lies adjacent the central region of a like container with adjacent side wall portions abutting in face to face relationship.

Figure 7:
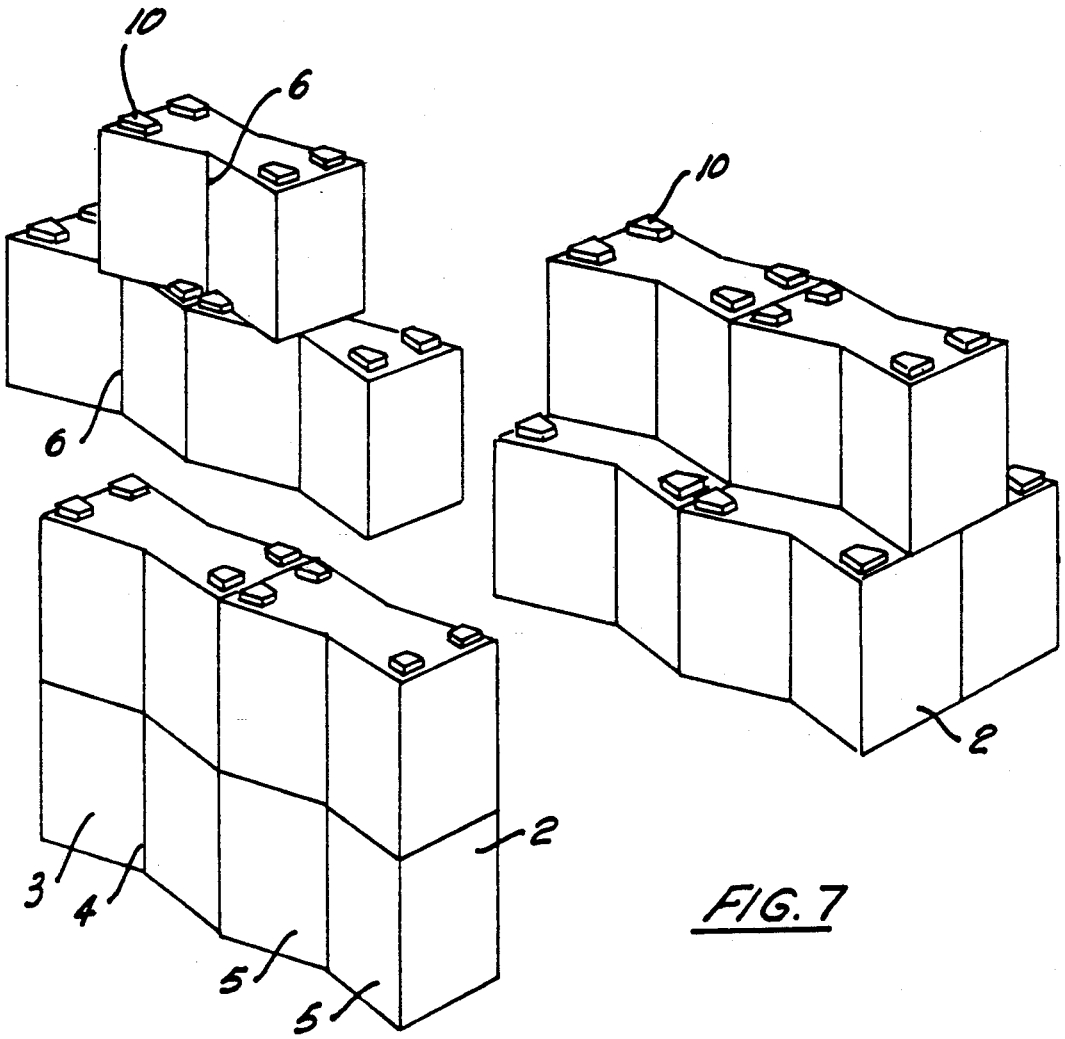
FIG. 7 is a series of perspective views showing a number of the containers stacked in various configurations.

The upper surface of each container includes four upwardly extending projections 10 disposed respectively adjacent the upper corners of the container for releaseable interengagement with a corresponding locating formation in the form of a peripheral edge flange 11 extending downwardly from the bottom of a like container to prevent relative movement of adjacent containers stacked in a particular mating configuration. A number of such stacking configurations are shown in FIG. 7. In addition, a plurality of like containers arranged in any desired array can be conveniently shrinked wrapped to facilitate transportation and storage.

It will be appreciated that stackable containers according to the invention may be manufactured by any suitable means. However, it is preferred that the container is manufactured according to the process described in the present applicant's copending Australian patent application number 21802/88, the full contents of which is incorporated herein by cross-reference.

It will be appreciated that the stackable containers according to the invention offer a number of commercially significant advantages, including the following:

(a) The containers have a larger surface area than corresponding rectangular or square prismatic cartons, which is desirable for advertising and display purposes;

(b) The intermediate portion of reduced width provides an excellent hand grip section, is visually attractive and is less prone to "bellying";

(c) The articles lend themselves well to display when arranged in various arrays.

(d) A stack of the containers is inherently stable because the containers are nestingly stackable in close packed arrays, and are positively located relative to adjacent containers by the corresponding interengageable locating formations.

The containers may be manufactured from a variety of materials including plastics, cardboard, metal and the like and may be formed from a composite comprising several layers. Where the container comprises a hollow lining member, the lining member may have barrier, adhesive, sealing, welding or other properties as desired to suit particular applications.

Although the invention has been described with reference to specific examples, it will be appreciated by those skilled in the art that the invention may be embodied in many other forms.

We claim:

1. A stackable container partially defined by two spaced apart side walls and two spaced apart end walls, a portion of each said side wall converging inwardly toward a central region of reduced width relative to the end walls to define a surface profile on each side wall which is a mirror image of a corresponding part of the other side wall whereby like containers can be stacked in an overlapping manner to form a close packed array and wherein a surface of the container includes a number of projections adapted for engagement with a corresponding locating formation on a complementary surface of a like container to prevent relative movement of adjacent containers stacked in mating configuration.

2. A stackable container according to claim 1 wherein the ends of the container are substantially parallel.

3. A stackable container according to claim 1 having a generally butterfly shaped configuration when viewed in plan.

4. A stackable container partially defined by two spaced apart side walls, a portion of each said side wall converging inwardly toward the other side wall to define a surface profile on each side wall which is a mirror image of a corresponding part of the other side wall whereby like containers can be stacked in an overlapping manner to form a closed packed array, said container including a plurality of projections protruding upwardly from a top of each container adjacent the respective corners thereof for releasable locating engagement with a peripheral edge flange extending downwardly from the bottom of a like container.

* * * * *